United States Patent [19]

Holappa

[11] 4,198,044

[45] Apr. 15, 1980

[54] EXERCISE BOARD

[76] Inventor: Vaino A. Holappa, 2739 Noble Rd., Cleveland Heights, Ohio 44121

[21] Appl. No.: 953,092

[22] Filed: Oct. 20, 1978

[51] Int. Cl.[2] ..... A63B 21/00

[52] U.S. Cl. ..... 272/135; 272/136; 272/144

[58] Field of Search ..... 272/144, 142, 145, 134, 272/135, 136, 138, 116; 128/24 R, 25 R, 25 A, 134; 5/82 R, 89

[56] References Cited

U.S. PATENT DOCUMENTS

| | | | |
|---|---|---|---|
| 1,019,861 | 3/1912 | Titus | 272/138 |
| 1,950,174 | 3/1934 | Harrison | 272/134 |
| 3,117,782 | 1/1964 | Johnston | 272/134 X |
| 3,285,070 | 11/1966 | McDonough | 272/134 |
| 3,545,748 | 12/1970 | Delinger | 272/134 X |
| 3,650,523 | 3/1972 | Darby, Jr. | 128/134 X |
| 3,966,200 | 6/1976 | Kirk | 272/144 X |

*Primary Examiner*—John D. Yasko

*Attorney, Agent, or Firm*—Maky, Renner, Otto & Boisselle

[57] ABSTRACT

An exercise board of generally rectangular form adapted to support the body of a person thereon characterized in that the sides and ends of the board have a plurality of laterally projecting eye bolts therealong and in that the leg end of the board has a longitudinally extending ladder-like slot between the person's legs, the eye bolts and rungs of the slot being selectively engaged by hooks at the ends of flexible elastically stretchable belts for embracing selected portions of the body for exercising the muscles of the legs, groin, abdomen, back, arms, shoulders, neck and including torso or trunk twisting exercises. The exercise board herein is further characterized in that the head end has an extension therefrom which provides a cross bar longitudinally spaced from and laterally offset from the head end of the board to provide a hand grip for performing body stretching exercises.

8 Claims, 10 Drawing Figures

EXERCISE BOARD

BACKGROUND OF THE INVENTION

Various forms of exercise boards or machines are disclosed in the following U.S. patents: Harrison, U.S. Pat. No. 1,950,174, dated May 27, 1932; Walker, U.S. Pat. No. 3,709,487, dated Jan. 9, 1973; Pridgen U.S. Pat. No. 3,834,694, dated Sept. 10, 1974; and Kirk U.S. Pat. No. 3,966,200, dated June 29, 1976.

In Harrison Pat. No. 1,950,174 the frame is supported on legs with braces and at each end of the frame is an adjustable extension providing a cross bar for connection of springs equipped with hand grips and ankle fasteners, the body of the person using the Harrison machine being supported on a carriage which is longitudinally slidable on the frame so that when the arms are exercised the springs connected to the ankles stretches the legs of the person as the carriage moves from the cross bar to which the ankle connecting springs are secured.

The Walker Pat. No. 3,709,487 discloses a complex form of foldable exercise apparatus which provides an inclined body supporting board for performing various exercises in connection with hand grips having springs hooked thereto and to the bottom of a support stand, and in one inclined position, the board constitutes a slant board in which the legs are secured to the upper end of the board for performing sit-ups and like exercises. The Walker exercise apparatus (when the board is removed or repositioned) enables performance of various exercises including chinning and lift-off exercises.

The Pridgen Pat. No. 2,834,694 discloses a leg exercising apparatus which includes a complex arrangement of pulleys and weights and which has an accessory for exercising the groin muscles.

The Kirk Pat. No. 3,966,200 relates to a stretching exercise device whilch includes a generally rectangular body support board on which a hand grip bar and a foot retaining bar are longitudinally adjustable for body stretching exercises.

SUMMARY OF THE INVENTION

In contradistinction to known exercise boards or machines the present invention is of simple lightweight but strong construction in which the generally rectangular tubular frame thereof has a plurality of spaced apart eye bolts along opposite sides and ends thereof and has a ladder-like slot from one end of the frame to the middle of the frame to be disposed between the legs of the person using the board, the eye bolts and rungs of the slot cooperating with snap hooks on the ends of flexible elastically stretchable belts which embrace any selected portions of the body for performance of a multitude of different exercises. In addition, the present exercise board has a detachable extension from the head end which provides a cross bar longitudinally spaced from and laterally offset from the head end for performance of stretching exercises when the user of the board grasps the cross bar with the hands of his or her outstretched arms.

DESCRIPTION OF THE PREFERRED EMBODIMENT

Figure 1:
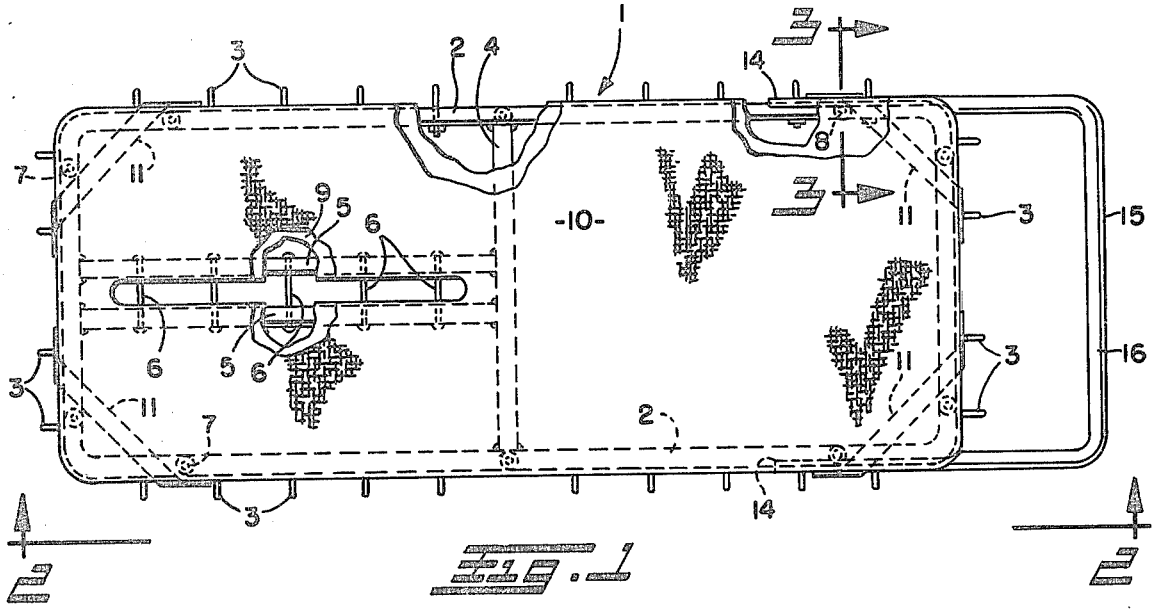
FIG. 1 is a top plan view of an exercise board embodying the present invention.
Figure 2:
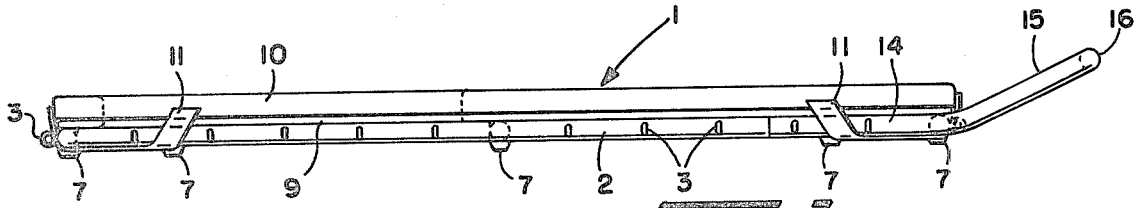
FIG. 2 is a side elevation view as viewed along the line 2—2, FIG. 1.
Figure 3:
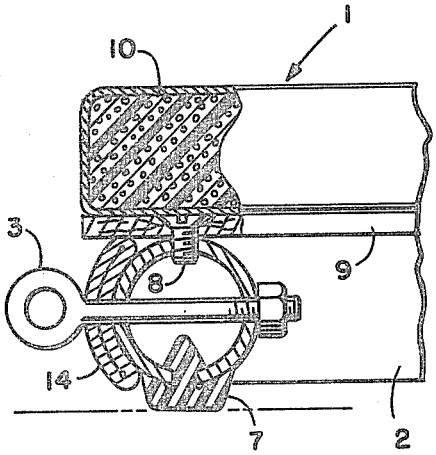
FIG. 3 is a fragmentary cross section view on enlarged scale taken substantially along the line 3—3, FIG. 1.

As best shown in FIGS. 1, 2 and 3 the exercise board 1 herein comprises a rectangular frame 2 fabricated as of lightweight aluminum tubing having eye bolts 3 projecting laterally from opposite sides and ends. A cross frame member 4 is welded or otherwise secured to the frame 2 intermediate the ends thereof and extending between the leg end of the frame 2 and the cross member 4 is a ladder-like structure comprising parallel side rail or frame members 5 welded or otherwise secured to said leg end and to said cross member 4 and rungs 6 in the form of rivets or bolts extending across the rail members 5 in spaced apart relation.

Rubber-like buttons 7 are snapped into holes in the bottom of the frame 2 to prevent marring of the floor or wall. Secured on the top of the frame 2 as by screws 8 is a rectangular body supporting panel 9 as of 5/32" or 3/16" plywood or pressed board and for comfort a fabric or plastic covered foam pad 10 is detachably secured to the frame 2 and panel 9 assembly as by means of the elastic straps 11 which are stretched over the corners of the frame 2. The pad 10 and panel 9 are slotted as shown in FIG. 1 to expose the rungs 6 of the ladder-like frame structure 5–6 for engagement by the snap hooks 12 at one end of a pair of flexible elastically stretchable belts 13 which are used with the exercise board 1 as shown in FIGS. 5 to 8, the snap hooks 12 at the other end of the belts 13 being hooked to selected eye bolts 3 on the opposite sides of the frame 2.

The belts 13 are preferably of fabric covered rubber and will be provided in various lengths and strengths to suit the strength of the person using the exercise board 1 and each belt 13 will be provided with snap hooks 12 at its ends for connection with selected eye bolts 3 on the ends or sides of the frame 2 or with selected rungs 6 of the ladder-like structure between the legs of the user.

Figure 7:
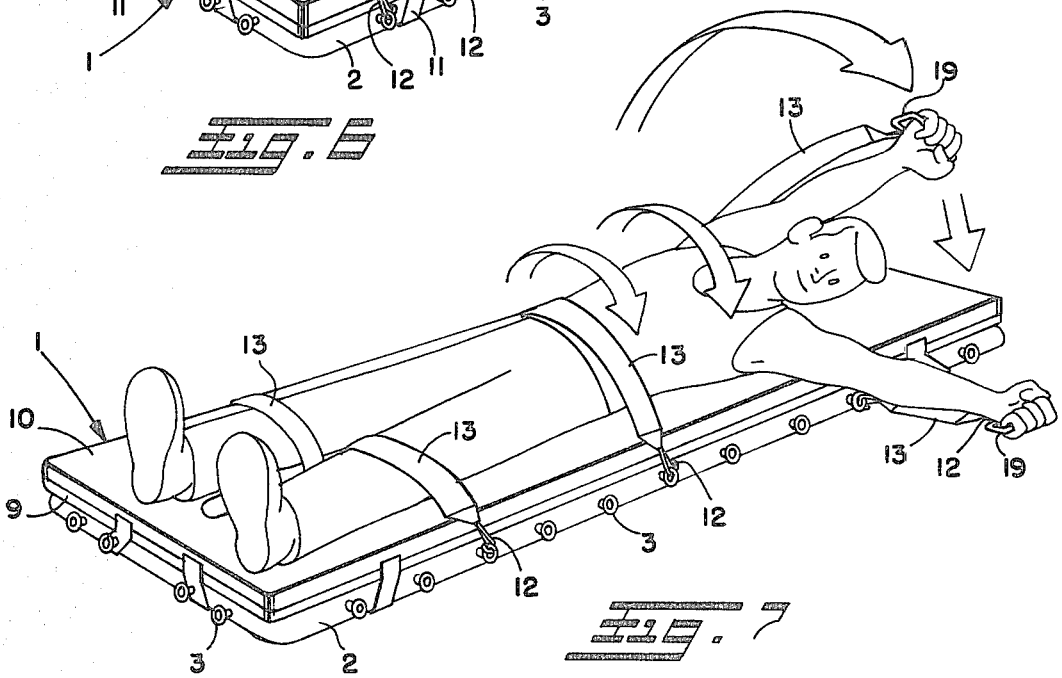
Figure 8:
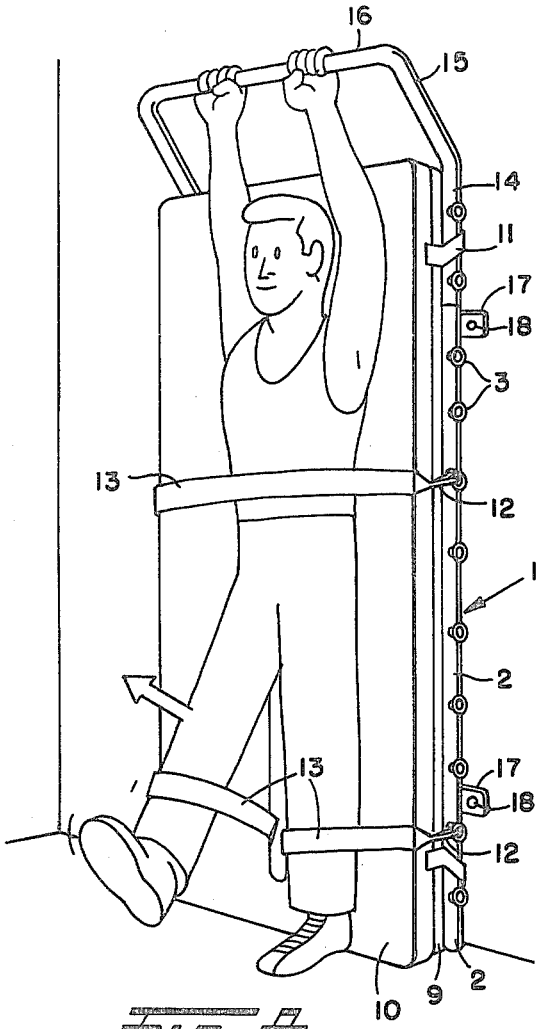
FIGS. 8 and 9 illustrate typical exercises which may be performed on the exercise board herein when mounted in vertical position against a wall.
Figure 9:
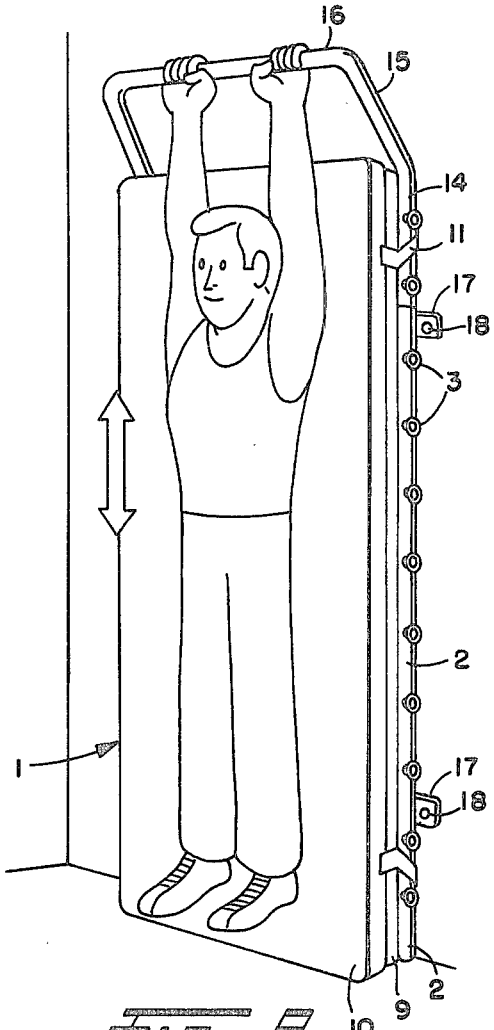

Detachably secured to the head end of the exercise board 1 as by the pair of eye bolts 3 thereat (see FIG. 3) are the arcuately flattened legs 14 of a U-shaped member 15 which beyond the head end of the frame 2 are inclined as shown to provide a hand grip bar 16 which is laterally offset from and longitudinally spaced from the exercise board 1 to provide hand clearance with the floor (FIGS. 1 to 7) or with the wall (FIGS. 8 and 9).

Figure 10:
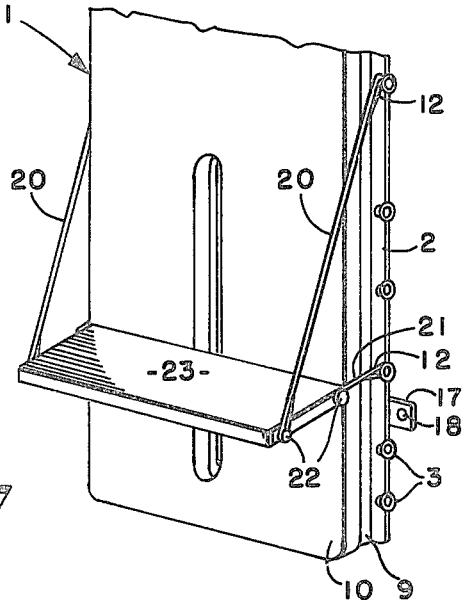
FIG. 10 illustrates a seat attachment for the vertically mounted exercise board.

For mounting of the exercise board 1 herein against a wall as shown in FIGS. 8, 9 and 10 angle brackets 17 are secured to the frame 2 as by the second and third eye bolts 3 adjacent the upper and lower ends ofthe frame 2, said brackets 17 being secured to a wall by screws 18.

FIGS. 4 to 7 show typical exercises which may be performed with the exercise board 1 supported on the floor.

Figure 4:
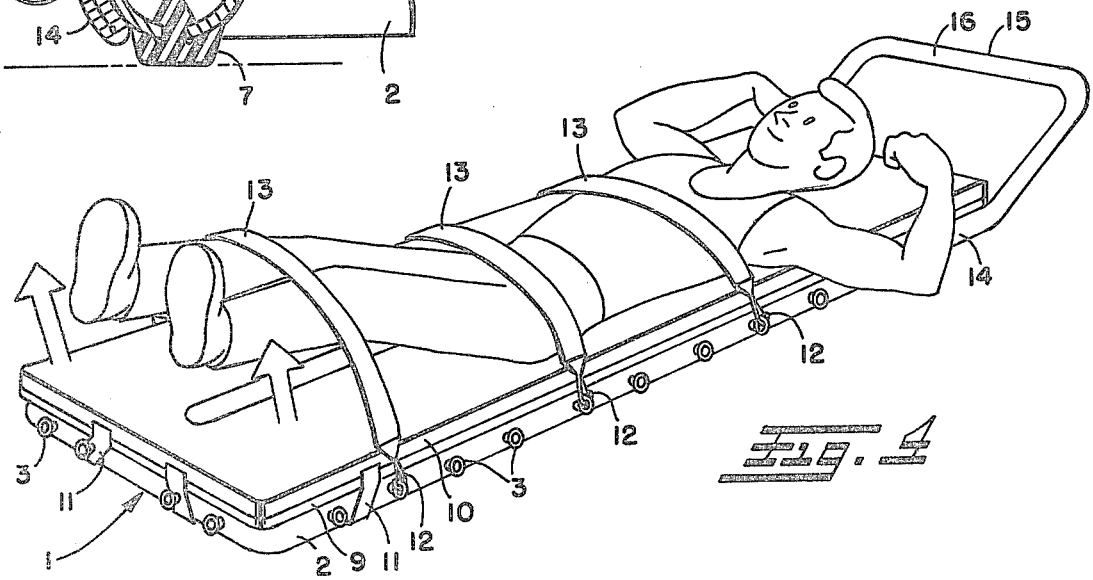
FIGS. 4 to 7 illustrate a few of the exercises which may be performed on the exercise board herein when supported in horizontal position on the floor.

FIG. 4 shows one belt 13 hooked to eye bolts 3 adjacent the leg end to extend over the legs below the knees so that the abdominal muscles may be exercised by lifting and lowering the legs as shown, the other two belts 13 being optional and, of course, partial sit-up exercise may be done while the legs are retained on the exerlcise board 1.

Figure 5:
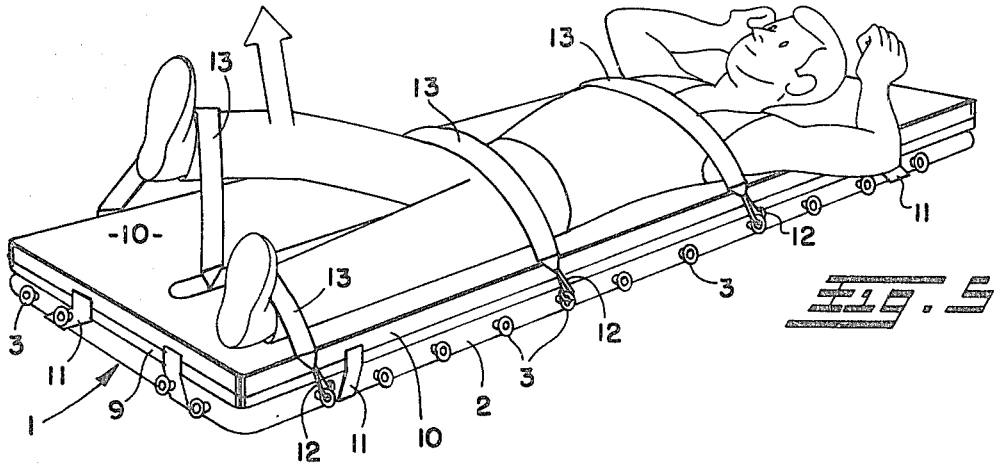

FIG. 5 shows another arrangement in which two belts 13 have one end hooked to a rung 6 and the other end hooked to eye bolts 3 on opposite sides of the exercise board 1 so as to embrace the ankles so that the legs may be individually exercised as shown.

Figure 6:
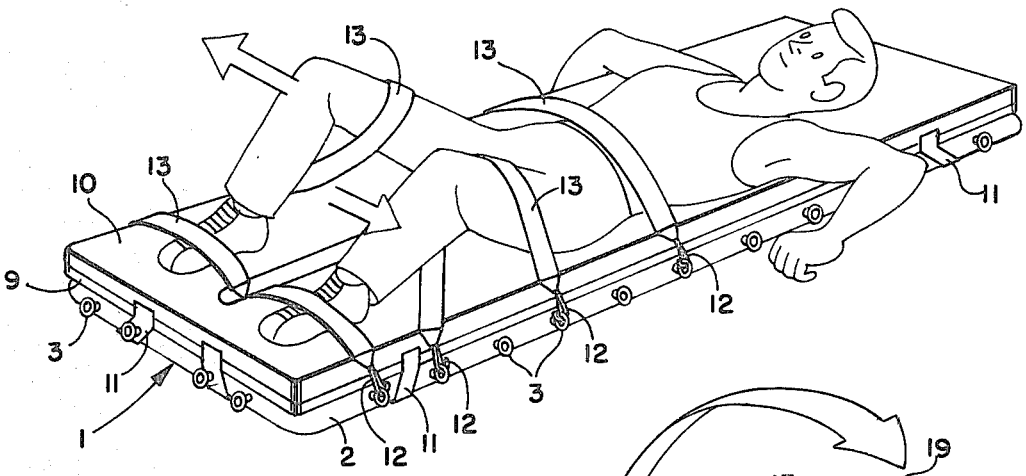

FIG. 6 shows yet another form of exercise for exercising the groin muscles with two belts 13 being hooked to a rung 6 and to opposite sides of the exercise board 1 to extend over the feet and, with the legs bent and knees spread apart, two other belts 13 may be hooked as shown with each belt being hooked to eye bolts 3 on the same side of the exercise board 1 so that groin muscle exercises may be performed by bringing the knees together and spreading them apart.

FIG. 7 shows a torso twisting exercise in which the legs are retained by belts 13 hooked at one end to opposite sides of the exercise board 1 corresponding to the area of the shoulders and with each belt 13 having a hand grip 19 connected to the snap hook 12 at its free end whereby when the arms are straight and are alternately swung in a generally vertical plane, the corresponding shoulder may be raised from the exercise board 1 while rolling on the other shoulder thus twisting the torso alternately in opposite directions.

FIG. 8 shows leg exercises with the belts 13 connected as in FIG. 5 in conjunction with stretching with the arms extended upward to grip the hand grip cross bar 16.

FIG. 9 also shows a stretching exercise and, if desired, the legs and abdomen may be exercised by moving the legs away from and toward the exercise board 1 simultaneously or alternately.

With reference to FIG. 10 there is shown therein an optional seat arrangement with nylon or like cords 20 and 21 having snap hooks 12 at one end engaged with screw eyes 22 at the ends of the seat 23, and snap hooks 12 at the other end hooked to the eye bolts 3 on the frame 2. The seat 23 may be thus mounted at a selected height and a person seated on the seat 23 may perform various arm and leg exercises in conjunction with elastic belts 13 hooked to selected eye bolts 3 or rungs 6.

It is to be understood that in FIGS. 4 to 7, the arms may be freely exercised or they may be outstretched to grasp the hand grips 19 of belts 13 which are hooked to eye bolts 3 at the head end of the frame 2 thus to perform arm exercises requiring exertion of muscular power to elastically stretch the belts 13.

The embodiments of the invention in which an exclusive property or privilege is claimed are defined as follows:

1. An exercise board comprising a rectangular body support having laterally projecting eyes along opposite sides and ends thereof and having a ladder-like structure extending longitudinally between the legs of a person on said support with rungs thereacross; and an elastically stretchable belt having hooks at its ends for selective detachable engagement with said eyes and rungs to overlie a desired portion of a person's body on said support so that movement of such portion stretches said belt thus to require exertion of muscular power to so move said body portion.

2. The exercise board of claim 1 wherein at least two of said belts, each having the hook at one end engaged with a selected rung and having the hook at the other end engaged with a selected eye on a side of the support individually embrace the desired portions of the legs of a person on said support.

3. The exercise board of claim 1 wherein another one of said belts has the hook at one end engaged with an eye adjacent the shoulder portion of a person on said support and the hook at the other end engaged with a hand grip for trunk twisting exercise by swinging of the arm in a generally vertical plane for raising the corresponding shoulder while the person rolls on the support on the other shoulder.

4. The exercise board of claim 1 wherein the head end of said support has a U-shaped member with its legs secured to opposite sides of said support, said legs being bent to provide a cross bar longitudinally spaced from and laterally offset from said head end for grasping by the hands of the outstretched arms of the person on said support for performing stretching exercises.

5. The exercise board of claim 1 wherein said support comprises a tubular frame member to which eye bolts are secured to provide said eyes, and a rectangular body support panel secured to said frame member, said panel having a longitudinal slot exposing said rungs for engagement by a hook of said belt.

6. The exercise board of claim 5 wherein an intermediate transverse tubular frame member has its ends secured to opposite sides of said tubular frame member, and a pair of longitudinal tube frame members parallel to opposite sides of said tubular frame member and having ends secured to one end of said tubular frame member and to said transverse tubular frame member to define the side rails of said ladder-like structure across which said rungs extend for selective detachable engagement by the hooks of one or more belts.

7. The exercise board of claim 6 wherein a pad is detachably secured at its corners on said panel and rectangular frame member; said pad having a longitudinal slot registering with the slot of said panel.

8. The exercise board of claim 5 wherein a U-shaped tubular member has arcuately flattened leg portions secured to opposite sides of said tubular frame member by eye bolts adjacent the head end of said tubular frame member and has a cross-bar portion laterally offset from said panel and longitudinally spaced from said head end of said tubular frame member to provide a hand grip cross-bar which provides clearance with the floor or with a wall to which said exercise board is adapted to be mounted.

* * * * *